United States Patent [19]

D'Andrade

[11] 4,297,808

[45] Nov. 3, 1981

[54] TETHERED TOY FOR ORBITAL MOVEMENT

[75] Inventor: Bruce M. D'Andrade, Whitehouse Station, N.J.

[73] Assignee: Arco Industries Ltd., Hong Kong

[21] Appl. No.: 157,179

[22] Filed: Jun. 6, 1980

[51] Int. Cl.[3] ..... A63H 5/00

[52] U.S. Cl. ..... 46/52; 46/59; 46/77

[58] Field of Search ..... 46/52, 51, 47, 77, 59

[56] References Cited

U.S. PATENT DOCUMENTS

| | | | |
|---|---|---|---|
| 2,404,265 | 7/1946 | Zimmerman | 46/52 |
| 2,559,050 | 7/1951 | Clair | 46/77 X |
| 2,573,219 | 10/1951 | Pursell | 46/77 |
| 2,958,156 | 11/1960 | Schmahl et al. | 46/51 |
| 2,968,119 | 1/1961 | Glass et al. | 46/77 |
| 3,030,733 | 4/1962 | Crawford | 46/243 |
| 3,236,008 | 2/1966 | Ryan | 46/191 |
| 4,047,323 | 9/1977 | Biffi | 46/77 X |

FOREIGN PATENT DOCUMENTS

| | | | |
|---|---|---|---|
| 998800 | 7/1965 | United Kingdom | 46/51 |

*Primary Examiner*—Hugh R. Chamblee
*Assistant Examiner*—Mickey Yu
*Attorney, Agent, or Firm*—C. Hercus Just

[57] ABSTRACT

A toy tethered for orbital movement and connected to one end of a cable coiled about a drum in a circular housing rotatable about one end of a hollow handle which contains a coiled torsional spring connected to said drum to yieldably resist uncoiling of said cable from said drum, the handle being held manually, and said toy having noise-generating mechanism operable as the toy is whirled about the handle through the air. One embodiment of toy comprises a toy aeroplane having a propeller supported at the front end of a shaft supported axially in the forward end of the fuselage of said aeroplane and the inner end of said shaft supporting a rotatable impeller operable against a diaphragm in said fuselage to produce a staccato-like noise resembling that of a motor. The centrifugal force generated by the toy when rotating about said handle yieldably overcomes the resistance of said spring to permit said cable to extend and cause the toy to move circularly about said handle at varying distances corresponding to the centrifugal force generated by such movement of the toy.

2 Claims, 7 Drawing Figures

TETHERED TOY FOR ORBITAL MOVEMENT

BACKGROUND OF THE INVENTION

This invention pertains to a toy which is tethered upon the outer end of a cable of suitable strength and flexibility, the inner end of said cable being connected to a manually supported handle or similar device whereby the toy may be rotated about said handle at the outer end of said cable which extends in various ways and at varying distances from said handle.

Various types of tethered toys, including toy aeroplanes, have been developed heretofore. Typical examples of these comprise the subject matter, for example of prior U.S. Pat. Nos. 2,968,119 to Glass et al, dated Jan. 17, 1961, and 3,030,733 to Crawford, dated Apr. 24, 1962. In Glass et al, the nose end of the fuselage supports a propeller mounted on the forward end of a shaft which is rotated by means of an electric motor, operation of which is effected by batteries in a manually supported handle from which an electric cord extends to the motor of the aeroplane, whereby the propeller drives the aeroplane for orbital movement about the handle and, incidentally, includes noise-generating means simulating the sound of a motor. The patent to Crawford shows an aeroplane supported at one end of an extensible cable mounted upon a power-driven drum in the manually-held handle, whereby the cable may be extended to various distances and the centrifugal force caused by rotating the aeroplane about the handle causes the freely rotatable propeller to revolve, the power means in the handle also retracting the cable when desired.

Certain types of power-operated toy aeroplanes also have been developed which are supported by cable means, usually consisting of a pair of cables and these extend from a hand-held mechanism, especially for purposes of controlling the elevators and/or rudder of the aeroplane to simulate various maneuvers when the aeroplane is in flight and propelled by a power-operated propeller which is activated, for example, by a small gasoline engine. Examples of such control cables and aeroplanes of the type referred to comprise the subject matter of prior U.S. Pat. Nos. 2,559,050 to St. Clair, dated July 3, 1951, and 2,573,219 to Pursell, dated Oct. 30, 1951. In the St. Clair patent, the aeroplane is not disclosed but self-propelled toy aeroplanes are well-known as indicated by the Pursell patent. Another type of tethered toy is represented by U.S. Pat. No. 2,958,156 to Schmahl et al, dated Nov. 1, 1960, in which a hat may be worn by a child or other human, the hat having a central pedestal to which one end of a string or cable is secured, while a rotating ball having a torsion spring-controlled reel therein permits the ball to be extended various distances from the pedestal on the hat so as to rotate orbitally about said pedestal and the distance of the ball therefrom depends upon the speed of rotation of the ball about the pedestal, the speed of rotation varying the centrifugal force produced by wobbling the head of the operator at various speeds.

Noise-generating devices to simulate the sound of a motor not only are found in toy aeroplanes as in the patent to Glass et al, referred to above, but the same are also found in other types of toys, such as the wheeled toy comprising the subject matter of prior U.S. Pat. No. 3,236,008 to Ryan, dated Feb. 23, 1966, and in which a rotatable impeller having loosely mounted lugs or rings thereon engage a resounding diaphragm in a staccato-like manner to simulate the noise of a motor.

In accordance with the present invention, a relatively simple type of tethered toy aeroplane comprises the subject matter thereof which is of a different and improved type over the ones described hereinabove, details of the present invention being set forth hereinafter.

SUMMARY OF THE INVENTION

It is among the principal objects of the present invention to provide a toy which, for example, may be inexpensively, yet attractively, manufactured from synthetic resin or plastics and adapted to be whirled through the air while attached to the outer end of a flexible cord coiled about a drum on the interior of a head rotatably mounted upon the upper end of a manually held handle within which a coiled torsional spring is mounted for attachment to the drum to resist uncoiling of the cord from the drum until sufficient centrifugal force has been generated by the whirling of the toy to overcome the resistance offered by the spring in the handle. Said spring also automatically retracts the cord about the drum as the centrifugal force is lessened. Noise-generating means also is included in the toy which is operated as the toy whirls through the air in a circular orbit about the handle and one highly suitable type of toy is an aeroplane in which the noise-generating means is included in the fuselage. Different amounts of centrifugal force are produced to effect uncoiling of said cable, the speed of the toy being more or less proportional to the amount of cable which has been extended from the drum and the rotatable toy effects proportional pitches of audible sound according to the speed of the toy.

Another object of the invention is to provide said head on the upper end of the hollow handle with a hollow cap in the shape of an inverted cup having cylindrical sidewalls provided with a hole through which the cord extends from the drum and said handle has a shaft rotatable therein about the longitudinal axis of the handle with the upper end fixed non-rotatably to said cap, said spring also being an elongated coiled torsion spring extending between a hub fixed to said drum which is rotatable about the upper end of the shaft and another hub fixed to the lower end of the shaft and rotatable within a bearing hole in the lower end of said handle.

A further object directly ancillary to the foregoing object is to arrange the above-described elements in the hollow handle in such manner that the shell of the handle remains stationary while the cord extended from the cap on the head rotates the head about the handle and as centrifugal force causes the cord to pay out from said head, the drum is rotated to rotate one end of the spring in coiling direction about the shaft to energize the same while the cap of the head holds the shaft and opposite end of the spring stationary upon the shaft to effect said coiling of the spring.

Another object of the invention is to provide the embodiment of a toy aeroplane with a propeller which has a plurality of flexible blades to minimize breakage thereof incident to the aeroplane being brought to rest when rotation thereof about the axis of the handle ceases and said cable is retractably coiled around the drum at the completion of operation of the toy aeroplane and said propeller being the sole means to rotate a shaft to operate a noise-generating unit within the fuselage of the aeroplane.

A further object of the invention ancillary to the foregoing object is to provide the propeller with a plurality of blades in excess of two to provide sufficient power to operate said rotatable impeller of the noise-generating unit without requiring the use of propeller blades of abnormal length.

Still another object of the invention is to provide said noise-generating unit with a diaphragm supported by the fuselage of the aeroplane and the impeller having oppositely balanced beater elements supported by a disc-like means having pins thereon which extend through central openings larger than the diameters of said pins and the distances of said pins from the axis of the shaft being such as to cause said beater elements to extend outwardly beyond said disc-like means by centrifugal force when said propeller rotates such shaft in orbital flight and causes them to impinge upon said diaphragm to produce a staccato-like noise resembling the sound of an engine.

Still another object of the invention is to arrange the wings and fuselage of the aeroplane so that the lower surface of the ends of the oppositely-extending wing sections which are connected to said fuselage are substantially within the plane of the bottom surface of the fuselage and said diaphragm being supported by said bottom surface between said ends of said wing sections.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENT

Figure 1:
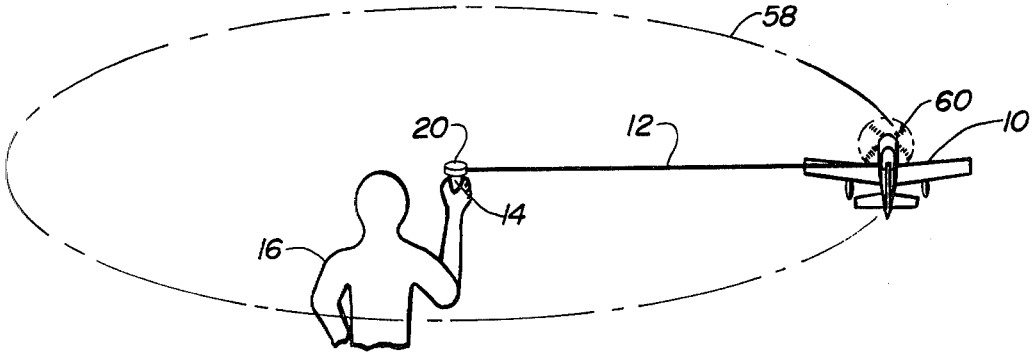
FIG. 1 is an exemplary illustration of a tethered toy being operated manually about a handle through an orbital path, the embodiment of the toy comprising an aeroplane.
Figure 2:
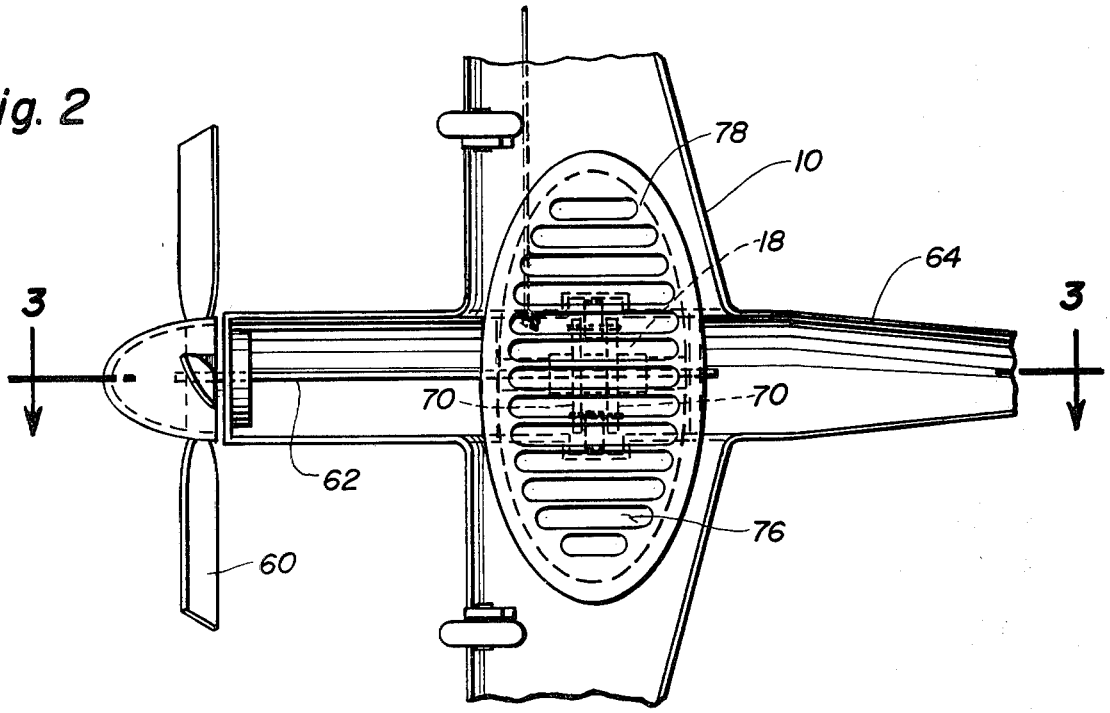
FIG. 2 is a fragmentary bottom plan view of the exemplary aeroplane shown in FIG. 1 and illustrating on a larger scale than in FIG. 1 portions of a noise-generating unit.
Figure 3:
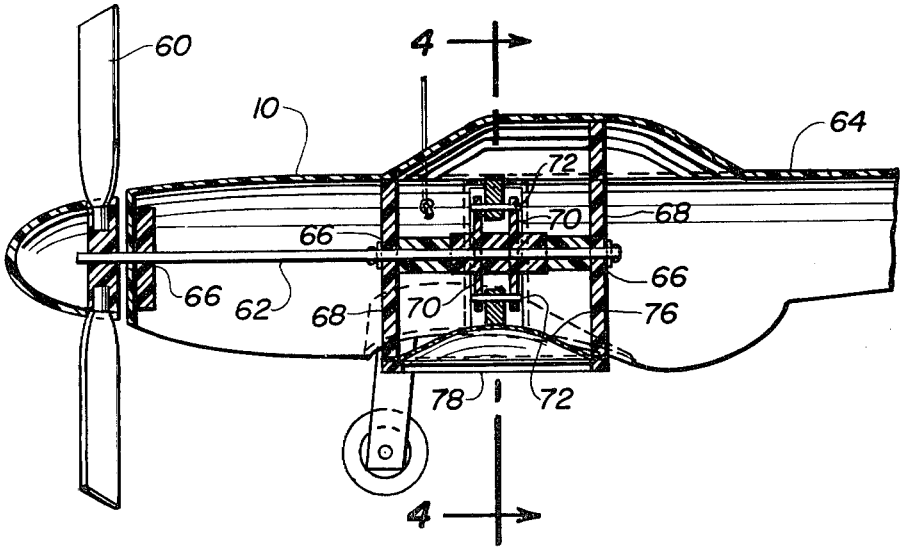
FIG. 3 is a fragmentary vertical sectional view of the aeroplane shown in FIG. 2, as seen on the line 3—3 thereof.
Figures 4, 5, 6, 7:
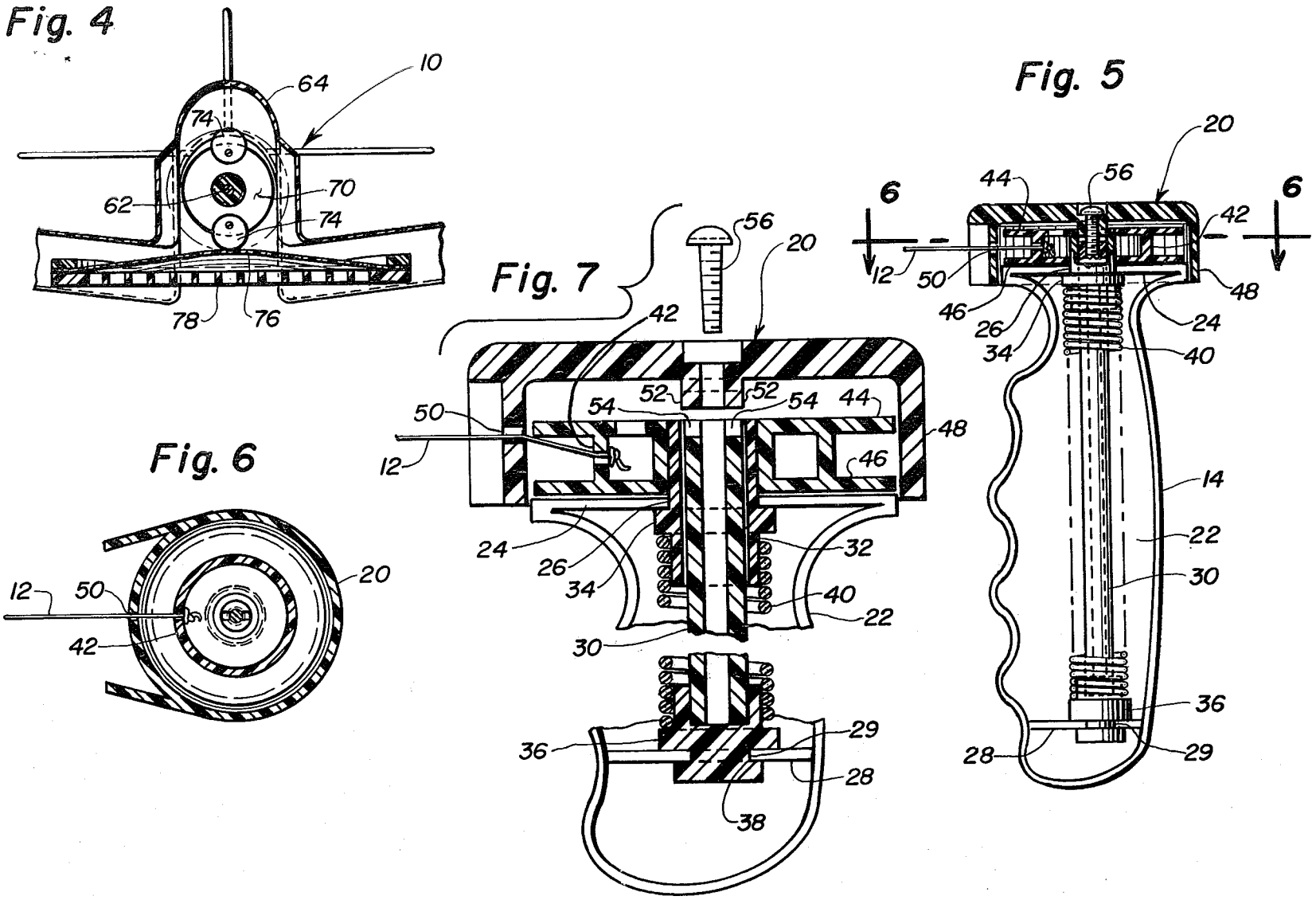
FIG. 4 is a transverse sectional view of the aeroplane shown in FIGS. 2 and 3, as seen on the line 4—4 of FIG. 3.
FIG. 5 is an enlarged vertical sectional view of the handle adapted from manual support by a human being, as illustrated diagrammatically in FIG. 1.
FIG. 6 is a transverse sectional view through the head of the handle shown in FIG. 5, as seen on the line 6—6 thereof.
FIG. 7 is a further enlarged vertical sectional view of the head and handle shown in FIG. 5 and foreshortened to accommodate the same to the sheet.

Referring to FIG. 1, it will be seen that the present invention comprises a tethered toy body 10 exemplified in said figure by a toy aeroplane attached to one end of a flexible cord 12 which preferably is formed of strong tensile textile material, one suitable embodiment of which is merchandised under the trade name NYLON, manufactured by the DuPont Company. The opposite end of the cord tether 12 is connected to coil means within the head of a handle 14, supported manually by an exemplified human being 16, such as a child. The exemplified toy body 10 also includes a noise-generating unit 18, details of which are best shown in FIGS. 2–4. For purposes of the present invention, however, the principal innovation resides in the handle 14 and the head 20, which is rotatably supported upon the upper end of the handle 14, details of said handle and head being as follows:

The handle 14 preferably is molded from rigid plastic material in suitable molds to render the same hollow and similar pairs of mirror images of the shell-like sections are suitably connected together by cement or otherwise to form a smooth outer surface for the handle 14. The upper end of the sections 22 are provided with an upper transverse web 24 having a central bearing hole 26 therein, and the lower portion of the sections 22 also are provided with another transverse web 28, having a bearing hole 29 therein. Extending longitudinally within the handle 14 is an elongated shaft 30, which may comprise a tubular plastic member as shown in longitudinal section in FIG. 7 and the upper end of the shaft 30 is surrounded by an upper hub 32, which has an annular shoulder 34 thereon, which abuts the lower surface of the upper transverse web 24.

A lower hub 36 has an annular groove 38 therein, the base of said groove being rotatably mounted within the bearing hole 29 in web 28. The lower hub 36 is fixedly connected to the lower end of shaft 30 by cement or otherwise and the hubs 32 and 36 are both preferably formed from relatively rigid plastic material. Extending between the hubs 32 and 36 is a longitudinal torsional type coiled spring 40, the opposite ends of which respectively are effectively secured to the lower portion of upper hub 32 and the upper portion of lower hub 36.

The upper portion of the upper hub 32 also has affixed thereto a coaxial drum 42 formed of plastic material and having similar upper and lower circular flanges 44 and 46 between which the flexible cord tether 12 is coiled, the inner ends thereof being secured to the base of the drum between the flanges 44 and 46.

The upper end of the handle 14 is surmounted by the aforementioned head 20, which specifically is in the form of an inverted cup having a substantially cylindrical sidewall 48, said sidewall having an opening 50 therethrough through which the cord 12 extends. From FIG. 7, in particular, it also will be seen that the lower circular flange 46 is adjacent the upper surface of the upper web 24 and in conjunction with the annular shoulder 34 on upper hub 32 stabilizes said upper hub 32 against axial movement but freely permits rotation thereof about the upper end of the shaft 30 as the drum 42 is rotated. The head 20 is fixedly secured to the upper end of shaft 30 in a non-rotatable manner, such as by providing a pair of lugs 52 on the central interior of the cup-shaped head 20, which respectively are received within complementary notches 54 in the upper end of shaft 30, it being understood that the head 20 preferably is made from relatively rigid plastic material and has a central hole therein to receive a connecting screw 56, which may, for example, be of the self-tapping type and be threaded into the hollow interior of the tubular shaft 30 to secure the cup-shaped cap 20 to the upper end of the shaft, particularly to secure the cap 20 to the handle in a rotatable manner, the lower edge of the sidewall 48 preferably extending downward, at least to surround the upper end of the handle 14 where the upper web 24 is located, as clearly shown in FIGS. 5 and 7.

From the foregoing, it will be seen that when the cord 12 is substantially completely coiled within the drum 42, and the outer end thereof is connected to the toy 10, it will be assumed that the spring 40 is preferably at least under slightly tensioned condition, but capable of being further tensioned by rotation of the drum, particularly as the cord 12 is paid out incident to centrifugal force caused by the orbiting of the toy 10 about its path 58, shown in exemplary manner in FIG. 1. Also, rotation of the head 20 about the handle 14 is under conditions where the cord 12 extends outwardly by means of centrifugal force and thereby maintains the head 20 in alignment with the hub 42 and causes corresponding rotation of the shaft 30, spring 40 and the upper and lower hubs within handle 14. If there is no increased tension placed upon the cord 12 during the whirling of the toy 10 about the handle 14, whereby the toy remains more or less in a fixed orbit, there will be no rotational movement of the drum 42 after initially establishing the orbit 58. Should an attempt be made to increase the speed of the toy 10 and increase the diameter of the orbit 58, however, the drum 42 will be rotated due to centrifugal force placed upon the cord 12 and this results in rotatable movement of the upper hub 34 upon the shaft 30 by means of rotation of the drum, but the lower end of the spring 40, which is fastened to the lower hub 36, remains stationary relative to the shaft 30, while the upper end of the spring which is connected to the upper hub 40 is rotating about the axis of the shaft 30, thus, increasing the tension upon the spring 40 and energizing the same to a greater extent for use in retracting the cord 12 in coiled manner about the drum 42 under conditions where, for example, the rotation of the toy 10 about the handle 14 is decreased incident to bringing the toy 10 to rest. It also will be understood that the swinging of the toy 10 into initial position causes uncoiling movement of the drum 42 and thereby places the spring 40 under initial tension, which may be increased or decreased, depending upon the manner in which the person holding the handle 14 manipulates the toy.

As indicated above, the toy 10 which is specifically illustrated in the attached drawings comprises a toy or model aeroplane is exemplary of other types of toys which may be whirled through the atmosphere at the end of the cord 12 in a tethered manner and preferably generate a desired noise or sound caused by the movement of the toy through the air. In regard to the aeroplane, which is specifically illustrated, the noise or sound-generating mechanism is best illustrated in FIGS. 2–4, in which it will be seen that the fuselage of the aeroplane 10 is provided with a propeller 60 on the nose thereof, which is supported by a rotatable shaft 62, which extends rearwardly into the fuselage 64 and is supported at opposite ends by appropriate bearings 66. The rearward portion of the shaft 62 extends between a pair of transverse walls 68 and supports a pair of discs 70 which are fixed to the shaft 62 for rotation therewith and a plurality of short pins 72 extend between the discs for purposes of loosely supporting a plurality of circumferentially spaced beater elements 74, which, as the discs 70 are rapidly rotated, strike in a staccato-like manner against a stiff diaphragm 76 which is fixedly mounted just above a protective grill 78. The discs 70 and elements 74 actually comprise a rotatable impeller and the noise produced thereby with respect to the diaphragm 76 closely resembles the sound of a piston-type aeroplane, which is quite realistic and of interest, particularly to children operating the toy.

While the aeroplane specifically shown in FIGS. 1–4 comprises a highly desirable type of toy to be utilized in conjunction with the handle 14 in a tethered manner, as controlled by the cord 12 when swung about the handle 14, it nevertheless, is to be understood that various other types of toys, such as animated figures of various kinds of certain types presently popular may be substituted for the aeroplane, all in accordance with the spirit of the present invention.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A whirling type toy comprising in combination a toy body adapted to be whirled through a circular orbital path in the atmosphere around a hollow handle composed of complementary molded halves and adapted to be supported manually by a human being, a circular inverted cup-shaped head supported rotatably by one end of said handle for rotation about the axis of said handle, a drum mounted within said head for rotation about the axis of said handle, a flexible tethering cord coiled from one end around said drum and having the other end of said cord connected to said toy body, an elongated coiled torsional spring extending axially within said handle and interconnected at one end to said drum, a shaft extending axially within said handle and fixed at one end to said head for rotation within said handle when said head is rotated around the axis of said handle to whirl said toy body through said orbital path and the other end of said spring being fastened to said shaft, an upper hub having a bearing opening rotatable about the upper end of said shaft and fixed to said drum and the upper end of said spring being fixed to said upper hub and thereby being fixed to said drum, a lower hub of a similar diameter to said upper hub fixed to the lower end of said shaft and the lower end of said spring being fixed to said lower hub, the upper end of said handle and lower end portion of said handle having transverse webs provided with bearing openings within which upper and lower hubs respectively are rotatable, the transverse web at the upper end of said handle having a diameter slightly less than the inner diameter of said head and coaxial therewith and said upper hub being rotatable within the bearing in said upper web and around said shaft in a manner to maintain the upper end of said handle free of contact with said head, the coil of said spring being in a direction to yieldably resist said cord being extended from said drum but yieldable to centrifugal force generated incident to rotating said toy body to assume said orbital path about the axis of said handle, and the extension of said cord from said head by centrifugal force causing rotation of said drum in a direction to rotate the upper end of said spring connected thereto to energize said spring in a manner to retract said cord around said drum when said centrifugal force is decreased.

2. The toy according to claim 1 further characterized by said toy body comprising a toy aeroplane having a propeller fixed to a shaft rotatable in said body and provided with a plurality of flexible blades in excess of two and spaced evenly around the axis thereof and rotatable by air engaging the same while said body is moving along said orbital path, said blades being of even length and relatively short to minimize contact of the tips thereof with any landing surface when engaged by wheels and the like on said plane, and a noise-generating unit including a diaphragm extending along the lower portion of the body of said aeroplane and also including an impeller fixed to said shaft within said body and operated by said propeller, and said impeller having opposed loosely mounted disc-like means projectable against said diaphragm by centrifugal force when said shaft is rotated to simulate the sound of an aeroplane engine.

* * * * *